United States Patent [19]

Ljungberg

[11] Patent Number: 4,709,893

[45] Date of Patent: Dec. 1, 1987

[54] STRESS BRACE

[76] Inventor: Robert Ljungberg, 373 Cottonwood Dr., Williamville, N.Y. 14221

[21] Appl. No.: 912,004

[22] Filed: Sep. 26, 1986

[51] Int. Cl.[4] ..... A47G 29/00

[52] U.S. Cl. ..... 248/360; 248/232

[58] Field of Search ..... 248/360, 359, 213.3, 248/213.4, 232, 233, 234; 294/142, 143

[56] References Cited

U.S. PATENT DOCUMENTS

| | | | |
|---|---|---|---|
| 1,240,573 | 9/1917 | Hill et al. | 248/213.3 X |
| 2,053,987 | 9/1936 | Farley | 248/234 |
| 4,262,741 | 4/1981 | Rothenbucher | 248/232 X |

*Primary Examiner*—Ramon O. Ramirez

*Attorney, Agent, or Firm*—Cushman, Darby & Cushman

[57] ABSTRACT

A stress brace is disclosed which minimizes warping of the side walls of plastic parts, such as plastic radiator tanks, during storage. The stress brace of the present invention includes two spaced apart side beams which are bowed relative to one another so that when a radiator tank is mounted on the stress brace, the side walls of the tank are held slightly stressed outwardly so that inward warping of the side walls is minimized. A central support structure is also included in the brace which may be in the form of several crosswise supports. The crosswise supports maintain the side beams of the brace in space apart relation and assure that the side beams themselves will not warp.

19 Claims, 7 Drawing Figures

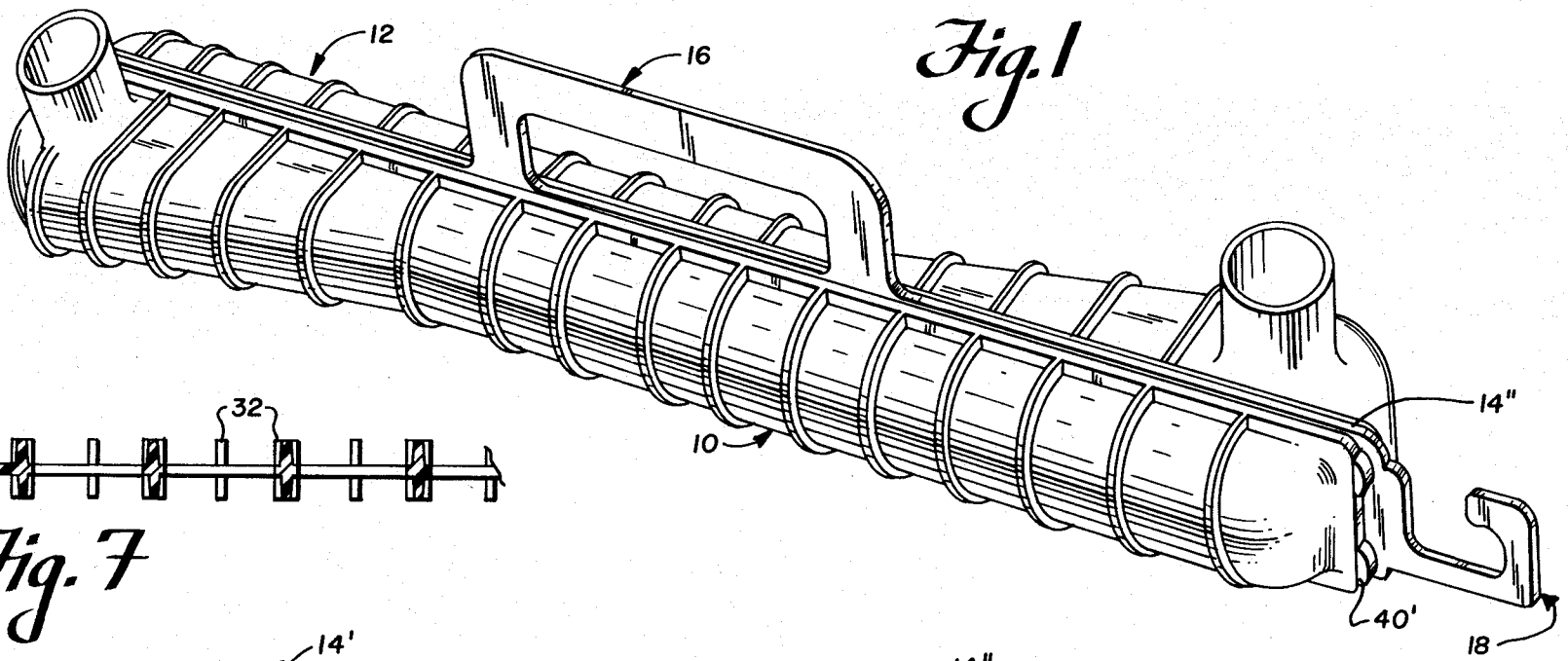
Fig. 1
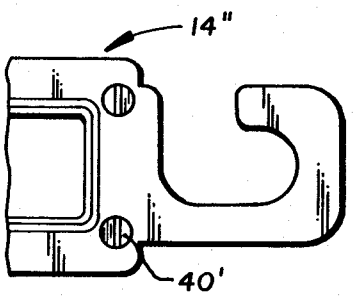
Fig. 6
Fig. 7
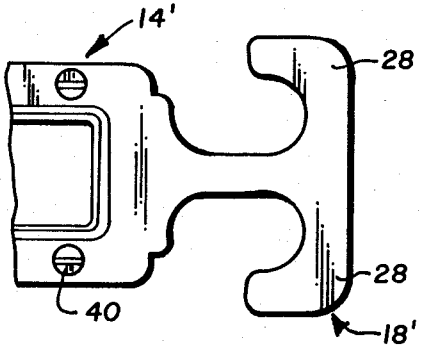
Fig. 5

STRESS BRACE

BACKGROUND OF THE INVENTION

The present invention relates to preventing warping of structures and, more particularly, to a stress brace for preventing warping of plastic parts during storage.

It is known to make radiators with some parts made of plastic. Of these parts which have been made of plastic, the tank is the very bottom part of the radiator to which the bottom hose is connected. When a radiator tank is coupled to the heat exchanging section of the radiator, a gasket is provided therebetween so as to assure a fluid-tight coupling.

One problem with plastic parts is that they tend to warp due to fluctuations in temperature and humidity. Warping is particularly prevalent along the lengthwise portions of the radiator tank where the walls tend to bow inwardly.

Another problem encountered with plastic radiator parts is that during storage the surface of the radiator tank which receives the gasket can become damaged by chipping or scratching and hence a fluid tight seal may not be achieved when the radiator tank is coupled to the main body of the radiator.

SUMMARY OF THE INVENTION

The present invention overcomes the foregoing problems of warping during the storage by providing a stress brace to which one or two parts can be connected. More particularly, the stress brace of the present invention includes two, spaced apart side supports. At least part of the central portions of the side supports are spaced apart a first distance and the end portions of the side beams being spaced apart a second distance different from the first. A support structure spans between the side supports to establish and maintain the spaced apart relation thereof. At least the side walls of a part mounted on the brace are held in a predetermined spaced relation by the side supports so that the tendency to warp will be minimized.

When the stress brace is used to prevent warping of radiator tanks, a radiator tank is mounted on the brace so that a portion of each of the side supports engages a respective inner edge of the longitudinal side walls of the tank. Further, the first distance between the side beams of a radiator tank brace is greater than the second distance. Accordingly, the side supports resist the tendency of the tank walls to warp or bow inwardly by maintaining the walls slightly stressed outwardly.

The stress brace of the present invention further preferably includes retainers for frictionally engaging and retaining an associated part to assure that it will be retained on the brace until it is removed for assembly. The retainers may be in the form of, for example, clips.

Finally, in order to prevent damage to the gasket sealing surface of the radiator tank, each of the side supports preferably includes a peripheral flange portion which engages and covers the gasket sealing surface of a radiator tank mounted thereon.

BRIEF DESCRIPTION OF THE DRAWINGS

Other objects, features, and characteristics of the present invention, as well as the methods of operation and functions of the related elements of the structure, and the combination and parts and economies of manufacture, will become more apparent upon consideration of the following description and the appended claims with reference to the accompanying drawings, all of which form a part of this specification, wherein like reference numerals designate corresponding parts in the various figures, of which:

FIG. 1 is a perspective view showing first and second radiator tanks coupled to a stress brace formed in accordance with the present invention;

FIG. 5 is a side elevational view, partly broken away, of an alternate embodiment of the stress brace of FIG. 2;

FIG. 6 is a side elevational view partly broken away, showing a second alternate embodiment of the stress brace of FIG. 2; and FIG. 7 is a sectional view, partly broken away, of yet another alternate embodiment of the stress brace of FIG. 2.

DETAILED DESCRIPTION OF THE PRESENTLY PREFERRED EXEMPLARY EMBODIMENTS

Referring to FIG. 1, the manner in which a stress brace formed in accordance with the present invention may be used to store radiator tanks is shown. More particularly, a radiator tank 10 and preferably first and second radiator tanks 10 and 12 are coupled to two first and second sides of stress brace 14″. In the preferred embodiment, stress brace 14″ is advantageously provided with a handle 16 so that the stored radiator tanks 10 and 12 can be readily transported while coupled to brace 14″. A hanger or hook 18 is further advantageously provided so that radiator tanks 10 and 12 coupled to brace 14″ can be hung from a suitable storage bar, bracket or the like.

Figure 2:
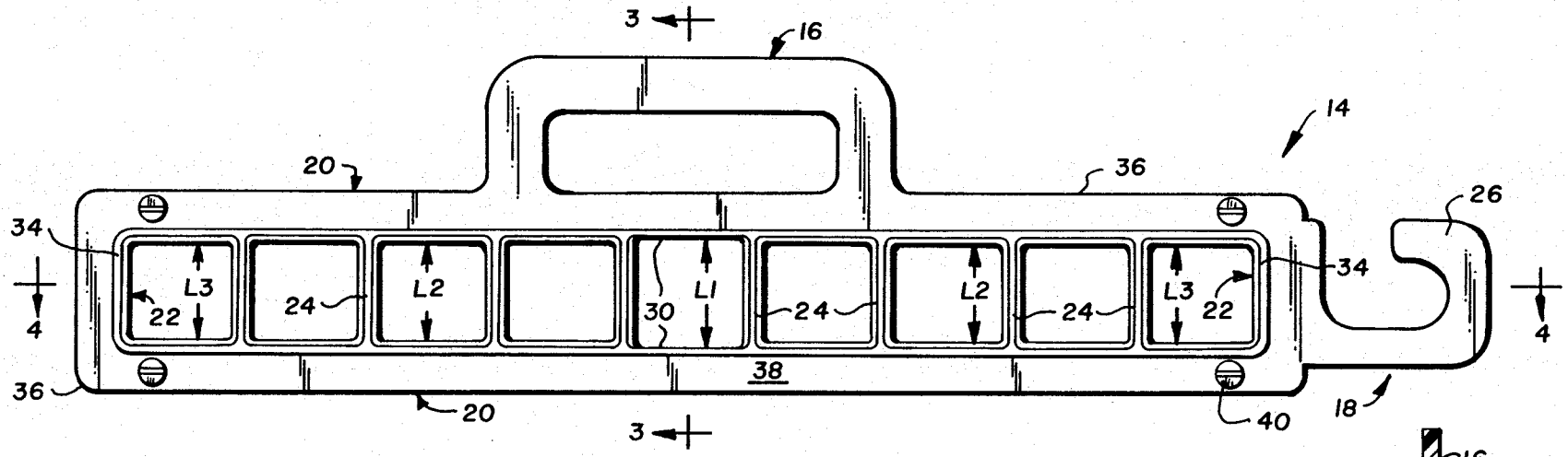
FIG. 2 is a side elevational view of a stress brace formed in accordance with the present invention.

Turning now to FIG. 2, a stress brace 14 formed in accordance with the present invention is shown without radiator tanks so that the advantageous structural features of the brace can be seen more clearly. Brace 14 includes first and second spaced apart longitudinal side supports such as beams 20 and a support structure spanning between side beams 20 so as to establish and maintain the spaced apart relation thereof. In the illustrated embodiment, the support structure includes first and second crosswise end beams 22 at the longitudinal ends of the side beams as well as a plurality of crosswise supports 24, as will be described more fully below. A handle 16 is most advantageously provided midway along one of side beams 20 for ease of transport of the brace and tank assembly. While in the illustrated embodiment only one handle 16 is shown, it is to be understood that a handle 16 could be provided on each side beam 20 of stress brace 14 so that brace 14 with radiator tanks mounted thereon can be readily picked up regardless of its storage position.

A hanger or hook 18 is further provided on the periphery of brace 14 so that the assembly can be hung from a suitable storage support as was stated above. In the embodiment illustrated in FIG. 2, hanger 18 includes a single hook element 26. Alternatively, as is shown in FIG. 5, a hanger 18′ can be provided which includes first and second hook portions 28 so that stress brace 14′ can be hung on a storage bar, hook or the like from either direction. In the alternative, brace 14' can be attached to two, parallel hanging devices so that swinging of the assembled brace and radiator tanks and, hence, chipping or scratching from engagement with adjacent structures is minimized.

Each of side beams 20 includes an upstanding portion 30 which is bowed relative to a plane that passes centrally between the side beams and perpendicularly relative to a horizontal plane of the side beams. In the illustrated embodiment, the bow of the upstanding portions is such that the distance between upstanding portions 30 is greatest at a midpoint of the brace and decreases gradually towards the ends thereof. Thus, as shown in FIG. 2, L1 is greater than L2 and L2 is greater than L3. In this manner, warping of the side walls of radiator tanks mounted on the brace will be resisted as will become more apparent below. Further, upstanding portions 30 are preferably provided on both sides of brace 14 so that two radiator tanks, for example, can be mounted on each brace and, hence, storage costs are minimized. Additionally, while in the preferred embodiment, upstanding portions 30 are in the form of elongated walls so that minimization of warping is assured at every point along the side walls of a mounted structure, the upstanding portions 30 can also be in the form of discrete projections 32 (shown in FIG. 7) which provide the requisite warp resistance.

As can be further seen in FIG. 2, end beams 22 also include upstanding wall portions 34 to provide further support and warp resistance. Additionally, side beams 20 and end beams 22 can include outwardly extending flange portions which define a peripheral flange 36 of brace 14. Flat faces 38 of flange 36 protect the gasket sealing surfaces of an associated radiator tank as will be described more fully below.

Referring more particularly to the spanning support structure of a brace formed in accordance with the present invention, in the illustrated embodiment the central portion of brace 14 includes a plurality of crosswise supports 24 which extend between longitudinal side beams 20. The crosswise supports 24 provide structural support for side beams 20 and upstanding portions 30 to assure that same will resist warping of an associated radiator tank and will not warp themselves.

Figure 3:
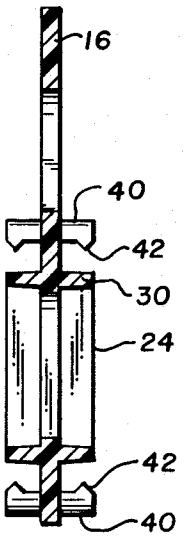
FIG. 3 is a sectional view taken along line 3—3 of FIG. 2.
Figure 4:
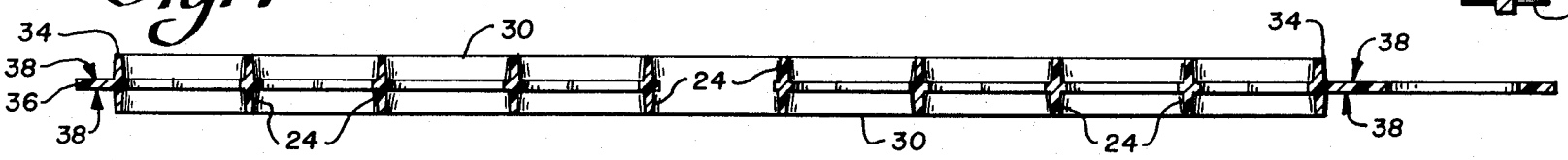
FIG. 4 is a sectional view taken along line 4—4 of FIG 2.

Referring to FIGS. 2 and 3, it can be seen that retainers such as clips 40 are provided at spaced locations on the flat faces 38 of peripheral flange 36. Each of clips 40 so provided includes an inwardly directed projection 42 for clamping an associated radiator tank on a side of brace 14. More particularly, an outwardly extending lip portion provided about the open edge of an tank is snapped past an associated projections 42 when the radiator tank is mounted onto a side of brace 14. Projections 42 retain the lip portion of the tank between same and flat face 38 so as to assure the radiator tank will be retained on the brace until intentional removal for assembly. Further, the radiator tank being firmly retained on the stress brace, flat faces 38 engage the gasket sealing surface of the tank to provide protection from scratching or chipping during storage or transport.

Turning now to FIG. 6, an alternate embodiment of the stress brace is shown, partially broken away for clarity. In this embodiment, the clips 40' are disposed on the end beams 22 of stress brace 14'' so as to frictionally retain the end walls of an associated radiator tank. While a radiator tank can be coupled to the stress brace with clips 40' in substantially the same manner as with clips 40, it has been found that because plastic parts tend to shrink lengthwise, where clips 40' are provided solely on end beams 22, and the radiator tank shrinks, the frictional retention of the radiator tank may be compromised. Accordingly, it is most preferred that at least some clips 40 be provided along side beams 20 of stress brace 14 so that retention of the radiator tank on the stress brace is assured.

As is apparent from the foregoing, when a radiator tank is attached to a side of stress brace 14, it is pressed against the side so that a lip formed about the open end of the radiator tank engages projections 42 of clips 40 and deflects the clips 40. Further movement of the radiator tank towards the stress brace so that the gasket sealing surface of the radiator tank engages flat face 38 enables clips 40 to resume an undeflected state with projections 42 clamping the radiator tank to the stress brace. With the radiator tank so attached, upstanding portions 30 and upstanding portions 34 will engage an inner edge portion of the side walls and end walls, respectively, of the radiator tank. The slight outward bowing of upstanding portions 30 as well as the crosswise supports 24 retain the longitudinal side walls of the tank so that they are slightly stressed outwardly. Thus, any tendency of the side walls of the tank to warp inwardly is resisted.

While the invention has been described in connection with what is presently considered to be the most practical and preferred embodiments, it is to be understood that the invention is not to be limited to the disclosed embodiments, but on the contrary, it is intended to cover various modifications and equivalent arrangements included within the spirit and scope of the appended claims.

What is claimed is:

1. A brace member for holding an article comprising:

two, spaced apart side, beam support members, said side beam members having end and central portions with at least part of the central portions being spaced apart a first distance and the end portions being spaced apart a second distance different from said first distance;

means for spanning between said side beam members to establish and maintain the spaced apart relationship thereof; and means for maintaining edges of said article in contact with said side support members.

2. A brace member as claimed in claim 1, wherein said support members are continuous wall elements.

3. A brace member as in claim 1, wherein said support members include discontinuous projecting portions.

4. A brace member as in claim 1, wherein said side support members each include an outwardly extending flange portion and a vertical wall portion, central sections of said wall portions of said side support members being spaced apart said first distance.

5. A brace member as in claim 1, wherein said maintaining means further include means for retaining said article thereon.

6. A brace member as in claim 4, wherein said maintaining means further include means for retaining said article thereon.

7. A brace member as in claim 6, wherein said means for retaining comprise clips formed on each said flange portion.

8. A brace member as in claim 1, wherein said first distance is greater than said second distance.

9. A brace member as in claim 1, wherein said means for spanning include first and second end beam members disposed between and coupled to the adjacent ends of said side suport members, respectively.

10. A brace member as in claim 1 wherein said means for spanning comprise a plurality of crosswise bar members couple at each end thereof to said side support members, respectively.

11. A stress brace for holding an article comprising:

first and second side beam members;

at least one cross bar member coupled at each end thereof to said first and second side beam members, respectively, so that said side beam members and each said bar member are disposed in a common horizontal plane;

each said side beam member including wall means at least at a central portion along the length thereof and disposed substantially vertically relative to said horizontal plane;

each said wall means being slightly bowed relative to a plane centrally disposed between said side beam members and perpendicular to said horizontal plane such that said wall means of said first side beam member and said wall means of said second side beam member are spaced apart a first distance at a midpoint of the brace and a second distance at a point spaced from said midpoint; and means for maintaining edges of said article in contact with said side beam members.

12. A stress brace as in claim 11, wherein there are a plurality of cross bar members, a first and second cross bar member being disposed between and coupled to adjacent ends of said first and second side beam members, respectively, so as to define end beam members for the brace.

13. A stress brace as in claim 12, wherein each said end beam member includes wall means disposed between and coupled at each end thereof to an end of each said wall means of said side beam members, respectively.

14. A stress brace as in claim 11, wherein each of said first and second side beam members further includes a longitudinal flange portion extending outwardly horizontally relative to said perpendicular plane.

15. A stress brace as in claim 14, wherein said means for maintaining comprises clip means provided on each of said longitudinal flange portions.

16. A stress brace as in claim 12, wherein said means for maintaining is disposed on said end beam members.

17. A stress brace as in claim 11, further comprising handle means mounted to at least one of said first and second side beam members.

18. A stress brace as in claim 12, further comprising hanger means mounted to at least one of said first and second end beam members for suspending the stress brace.

19. A stress brace as in claim 18, wherein said hanger means comprises first and second hook elements.

* * * * *